US009873279B2

(12) United States Patent
Niu et al.

(10) Patent No.: US 9,873,279 B2
(45) Date of Patent: Jan. 23, 2018

(54) PRINTABLE RECORDING MEDIA

(71) Applicant: Hewlett-Packard Development Company, L.P., Houston, TX (US)

(72) Inventors: Bor-Jiunn Niu, San Diego, CA (US); Tao Chen, San Diego, CA (US); Silke Courtenay, Temecula, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/307,298

(22) PCT Filed: Jul. 30, 2014

(86) PCT No.: PCT/US2014/048909
§ 371 (c)(1),
(2) Date: Oct. 27, 2016

(87) PCT Pub. No.: WO2016/018310
PCT Pub. Date: Feb. 4, 2016

(65) Prior Publication Data

US 2017/0043605 A1 Feb. 16, 2017

(51) Int. Cl.
*B41M 5/00* (2006.01)
*B41M 5/52* (2006.01)
*B41J 11/00* (2006.01)

(52) U.S. Cl.
CPC ..... *B41M 5/529* (2013.01); *B41J 11/002* (2013.01); *B41M 5/5209* (2013.01); *B41M 5/5281* (2013.01); *B41M 2205/34* (2013.01)

(58) Field of Classification Search
CPC .. B41M 5/504; B41M 5/5209; B41M 5/5281; B41M 7/0081; B05D 1/00
See application file for complete search history.

(56) References Cited

U.S. PATENT DOCUMENTS

| | | | | |
|---|---|---|---|---|
| 6,815,468 | B2 | 11/2004 | Nixon et al. | |
| 7,202,285 | B2 | 4/2007 | Runacre et al. | |
| 7,427,429 | B2 | 9/2008 | Xing et al. | |
| 7,977,398 | B2 | 7/2011 | Cornell et al. | |
| 2003/0224150 | A1* | 12/2003 | Ludwig | B41M 5/5281 428/195.1 |

(Continued)

FOREIGN PATENT DOCUMENTS

| | | |
|---|---|---|
| EP | 2154213 | 2/2010 |
| JP | 2008221824 | 9/2008 |

(Continued)

OTHER PUBLICATIONS

Lee, B. et al. "Coating Performance and Characteristics for UV-curable Aliphatic Urethane Acrylate Coatings Containing Norrish Type I Photoinitiators", pub Jul. 2006, 8pgs.

(Continued)

*Primary Examiner* — Betelhem Shewareged
(74) *Attorney, Agent, or Firm* — HP Inc. Patent Department

(57) ABSTRACT

A printable recording media containing a substrate and an ink receiving layer including an aqueous mixture of about 50 to about 99 wt % of an UV curable polyurethane dispersion and about 1 to about 50 wt % of a photo-initiator by total dry weight of said ink receiving layer. Also disclosed herein a method for making the printable recording media.

19 Claims, 1 Drawing Sheet

(56) References Cited

U.S. PATENT DOCUMENTS

| | | | | |
|---|---|---|---|---|
| 2004/0242735 | A1* | 12/2004 | McMan | C09D 4/00 524/91 |
| 2004/0242763 | A1* | 12/2004 | Tielemans | C08G 18/0823 524/589 |
| 2005/0195260 | A1 | 9/2005 | Figov et al. | |
| 2006/0088674 | A1 | 4/2006 | Hladik et al. | |
| 2006/0088675 | A1 | 4/2006 | Hladik et al. | |
| 2007/0197384 | A1 | 8/2007 | Yan | |
| 2010/0151143 | A1 | 6/2010 | Cornell et al. | |
| 2011/0254909 | A1* | 10/2011 | Lu | B41M 5/00 347/102 |
| 2013/0237626 | A1 | 9/2013 | Bishop et al. | |
| 2015/0203697 | A1* | 7/2015 | Brandstein | C09D 11/101 347/20 |

FOREIGN PATENT DOCUMENTS

| | | | |
|---|---|---|---|
| WO | WO-2000-024529 | A1 | 5/2000 |
| WO | WO-2001-010640 | A1 | 2/2001 |

OTHER PUBLICATIONS

International Search Report and Written Opinion for International Application No. PCT/US2014/048909 dated Apr. 28, 2015, 12 pages.

* cited by examiner

PRINTABLE RECORDING MEDIA

BACKGROUND

Inkjet printing is a non-impact printing method in which an electronic signal controls and directs droplets or a stream of ink that can be deposited on a variety of substrates. Current inkjet printing technology involves forcing the ink drops through small nozzles by thermal ejection, piezoelectric pressure or oscillation, onto the surface of a media. This technology has become a popular way of recording images on various media surfaces, particularly paper, for a number of reasons, including low printer noise, capability of high-speed recording and multi-color recording. Inkjet web printing is a technology that is specifically well adapted for commercial and industrial printing. Recently, radiation curing printing techniques, where printed images are cured by exposure to radiation sources, such as ultraviolet (UV) for example, has become popular.

It has rapidly become apparent that the image quality of printed images using such printing technology is strongly dependent on the construction of the recording media used. Consequently, improved recording media, often specifically designed, have been developed. However, while many developments have been made, it has often created challenges to find effective printable recording media. Accordingly, investigations continue into developing such media substrates.

BRIEF DESCRIPTION OF THE DRAWING

The drawings illustrate various embodiments of the present recording media and are part of the specification.

DETAILED DESCRIPTION

Figure 1:
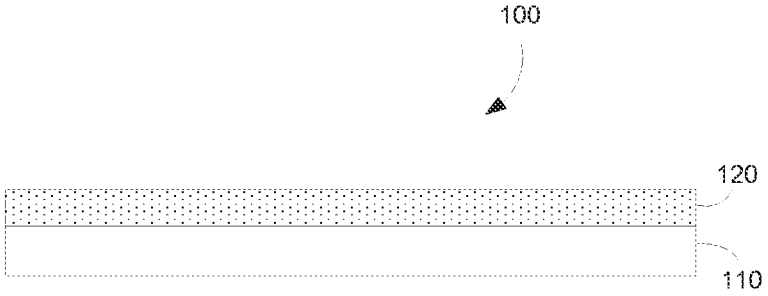
FIGS. 1 and 2 are cross-sectional views of the printable recording media according to embodiments of the present disclosure.

The present disclosure refers to printable recording media containing a substrate and an ink receiving layer including an aqueous mixture of about 50 to about 99 wt % of an UV curable polyurethane dispersion and about 1 to about 50 wt % of a photo-initiator by total dry weight of said ink receiving layer. The present disclosure refers also to a method for making the printable recording media and to a method for producing printed images using the recording media.

Before particular embodiments of the present disclosure are disclosed and described, it is to be understood that the present disclosure is not limited to the particular process and materials disclosed herein. It is also to be understood that the terminology used herein is used for describing particular embodiments only and is not intended to be limiting, as the scope of protection will be defined by the claims and equivalents thereof. In describing and claiming the present media and method, the following terminology will be used: the singular forms "a", "an", and "the" include plural referents unless the context clearly dictates otherwise. Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For examples, a weight range of about 1 wt % to about 20 wt % should be interpreted to include not only the explicitly recited concentration limits of 1 wt % to 20 wt %, but also to include individual concentrations such as 2 wt %, 3 wt %, 4 wt %, and sub-ranges such as 5 wt % to 15 wt %, 10 wt % to 20 wt %, etc. All percent are by weight (wt %) unless otherwise indicated. "Dry weight" refers herein to the weight of a component when the liquid it is suspended or dissolved into has been removed. As used herein, "image" refers to marks, signs, symbols, figures, indications, and/or appearances deposited upon a material or substrate with either visible or an invisible ink composition. Examples of an image can include characters, words, numbers, alphanumeric symbols, punctuation, text, lines, underlines, highlights, and the like.

The printable recording media, described herein, provides printed images that demonstrate excellent image quality (good bleed and coalescence performance) and enhance durability performance while enabling high-speed printing. By high-speed printing, it is meant herein that the printing method can be done at a speed of 50 fpm or higher. As durability performance, it is meant herein that the resulting printed images are robust to dry and wet rubbing that can be done by going through finishing equipment (slitting, sheeting, folding, etc.) or for different applications by end users.

In some examples, the printable recording media is a photo-curable media. It means herein that the media is very well adapted to photo-curable printing methods. Photo-curable printing methods contain a curing step where the media and/or printed article go through a curing process. The term "curing", in the context of the present disclosure, refers to a process of converting a liquid, such as ink, into a solid by exposure to actinic radiation such as photo-radiation, e.g., ultraviolet (UV) radiation. In the uncured state, ink compositions have a low viscosity and are readily jetted. However, upon exposure to suitable source of curing energy, for example ultraviolet (UV) light, electrons beam energy, and/or the like, there is a formation of a cross-linked polymer network. The printable media of the present disclosure is thus particularly well adapted to printing process where an UV curing step is used.

In some examples, the printable recording media described herein is a coated media that can be printed at speeds needed for commercial and other printers such as, for example, a Hewlett Packard (HP) Inkjet Web Press (Hewlett Packard Inc., Palo Alto, Calif., USA). The properties of such printable recording media are comparable to coated media for offset printing The recording media, the printing method and the article of the present disclosure have the ability to provide prints with improved printing performances, specifically improved adhesion performances to ink colorant particles. In some examples, the images printed on the recording media, such as described herein, are able to impart excellent image quality: provides vivid color, such as higher gamut and high color density. In some other examples, the printed images impart good adhesion capability to ink colorant when an ink composition is used for forming the printed image. Furthermore, when used in a printing process, the resulting printed image presents good wet and dry scrub strength as well as excellent ink adhesion to the surface.

The printable recording media according to the present disclosure provides printed images that have outstanding print durability and excellent scratch resistance (dry rubbing resistance as well as wet rubbing resistance). By scratch resistance, it is meant herein that the printed media is resistant to all modes of scratching which include, scuff, abrasion and burnishing. By the term "scuff", it is meant herein all damages to a print due to dragging something blunt across it (like brushing fingertips along printed image). Scuffs do not usually remove colorant but they do tend to change the gloss of the area that was scuffed. By the term "abrasion", it is meant herein the damage to a print due to wearing, grinding or rubbing away due to friction. Abrasion is correlated with removal of colorant (i.e. with the OD loss). An extreme abrasive failure would remove so much colorant that the underlying white of the paper would be revealed. The term "burnishing" refers herein to changing the gloss via rubbing. A burnishing failure appears as an area of differential gloss in a print.

The printable recording media, described herein, is considered to have improved flatness and decreased cockling problems, issues that are often founded in high speed printing applications. Indeed, some paper media can be subjected to problems relating to one or more of cockle, curl, wrinkle, crease, and/or mis-registration, which can detrimentally impact productivity, product quality and cost. For example, inkjet printing has a much higher moisture level than offset and gravure printing due to the colored pigments of the inkjet ink being applied to the paper media using, for example, a water based liquid vehicle, which might cause non-uniform hygro-expansion. Cockle refers to a small scale expansion in paper fiber width when wetted with water that might come from water-based inkjet inks.

Figure 2:
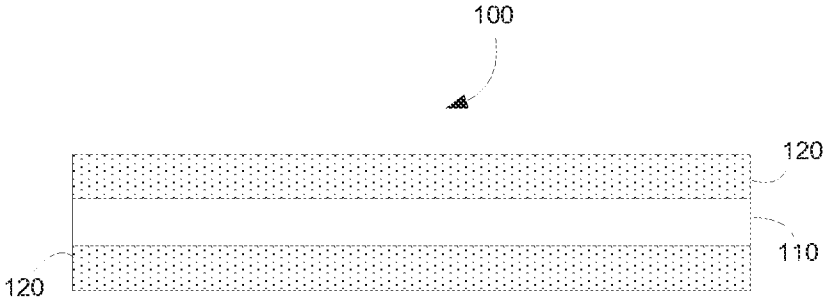

FIG. 1 and FIG. 2 illustrate the printable recording media (100) as described herein. In some examples, as illustrated in FIG. 1, the printable media (100) encompasses a bottom supporting substrate (110) and an ink receiving layer (120). The ink receiving layer (120) is applied on, at least, one side of the substrate (110). If the coated side is used as an image-receiving side, the other side, i.e. backside, may not have any coating at all, or may be coated with other chemicals (e.g. sizing agents) or coatings to meet certain features such as to balance the curl of the final product or to improve sheet feeding in printer. In some other examples, such as illustrated in FIG. 2, the ink receiving layer (120) is applied to both opposing sides of the substrate (110). The double-side coated media has thus a sandwich structure, i.e. both sides of the substrate (110) are coated and both sides may be printed.

The ink receiving layer (120) can be disposed on one side the supporting substrate (110) and can form a layer having a coat-weight in the range of about 0.5 to about 30 gram per square meter (g/m$^2$ or gsm), or in the range of about 1 to about 20 gsm, or in the range of about 1 to about 15 gsm per side. In some examples, the printable recording media has an ink receiving layer (120) that is applied to only one side of the supporting substrate (110) and that has a coat-weight in the range of about 2 to about 6 gsm. In some other examples, the printable recording media contains ink receiving layer (120) that is applied to both sides of the substrate (110) and that has a coat-weight in the range of about 1 to about 5 gsm per side.

In some examples, the present disclosure relates to an article comprising a paper substrate having a first and a second side; a coating layer applied on at least one side of said substrate, said layer comprising a mixture of water, aliphatic acrylate polyurethane dispersion or an aliphatic polyurethane dispersion and a photo-initiator wherein the ratio of polyurethane dispersion/photo-initiator is between 85/25 and 95/5.

As illustrated in FIG. 1, the printable media (100) contains a substrate (110) that supports the ink receiving layer(s) (120) and that acts as a bottom substrate layer or supporting base. Such substrate, which can also be called base print media substrate or base substrate or supporting substrate, contains a material that serves as a base upon which the ink receiving layer is applied. The substrate provides integrity for the resultant printable media. The amount of the ink receiving layer, on the media, in the dry state, is, at least, sufficient to hold all of the ink that is to be applied to the media.

The basis weight of the print media substrate is dependent on the nature of the application of the printable recording media where lighter weights are employed for magazines, books and tri-folds brochures and heavier weights are employed for post cards and packaging applications, for example. The substrate can have a basis weight of about 60 grams per square meter (g/m$^2$ or gsm) to about 400 gsm, or about 100 gsm to about 250 gsm.

In some examples, the substrate is a paper base substrate. The media substrate can also be a photo-base paper, an uncoated plain paper or a plain paper having a porous coating, such as a calendared paper, an un-calendared paper, a cast-coated paper, a clay coated paper, or a commercial offset paper. The photobase may be a paper that is coated by co-extrusion with a high- or low-density polyethylene, polypropylene, or polyester on both surfaces of the paper.

The substrate may include any materials which can support a coating composition, for example, natural materials (such as a base including cellulose fibers) or synthetic material, (such as a base including synthetic polymeric fibers) or non-fabric materials (such as a polymeric film) or a mixture of them. The substrate material has good affinity and good compatibility for the ink that is applied to the material.

Examples of substrates include, but are not limited to, natural cellulosic material, synthetic cellulosic material (such as, for example, cellulose diacetate, cellulose triacetate, cellulose propionate, cellulose butyrate, cellulose acetate butyrate and nitrocellulose), material including one or more polymers such as, for example, polyolefins, polyesters, polyamides, ethylene copolymers, polycarbonates, polyurethanes, polyalkylene oxides, polyester amides, polyethylene terephthalate, polyethylene, polystyrene, polypropylene, polycarbonate, polyvinyl acetal, polyalkyloxazolines, polyphenyl oxazolines, polyethylene-imines, polyvinyl pyrrolidones, and combinations of two or more of the above. The media substrate can be a paper base including paper, cardboard, paperboard, paper laminated with plastics, and paper coated with resin. The substrate may include polymeric binders. Such polymeric binder may be included, for example, when non-cellulose fibers are used. The substrate may include cellulose fibers and synthetic fibers. The cellulose fibers may be made from hardwood or softwood species. The fibers of the substrate material may be produced from chemical pulp, mechanical pulp, thermal mechanical pulp, chemical mechanical pulp or chemical thermo-mechanical pulp. Examples of wood pulps include, but are not limited to, Kraft pulps and sulfite pulps, each of which may or may not be bleached. Examples of softwoods include, but are not limited to, pine, spruce and hemlock. Examples of hardwoods include, but are not limited to, birch, maple, oak, poplar and aspen. The synthetic fibers may be made from polymerization of organic monomers. The substrate may also include non-cellulose fibers.

The printable media contains an ink receiving layer or coating layer (120) disposed onto the substrate (110). In some example, the ink receiving layer or inkjet receiving or ink recording layer or image receiving layer, is present on, at least, one side of the substrate (110). In some other examples, the ink receiving layer (120) is present on both sides of the substrate (110).

The ink receiving layer includes an aqueous mixture of about 50 to about 99 wt % of a UV curable polyurethane dispersion and about 1 to about 50 wt % of a photo-initiator wherein said weight percentages are by combined weight of the UV curable polyurethane dispersion and of the photo-initiator and are expressed by the total dry weight of the ink receiving layer. In some examples, the ink receiving layer includes an aqueous mixture of about 60 to about 95 wt % of a UV curable polyurethane dispersion and about 5 to about 40 wt % of photo-initiator by total dry weight of said ink receiving layer.

In some examples, the weight ratio of the UV curable polyurethane dispersion to the photo-initiator, in the ink receiving layer, is comprised between 80/20 and 99/1. In some other examples, the weight ratio of the UV curable polyurethane dispersion to the photo-initiator, in the ink receiving layer, is between 85/25 and 95/5.

The ink receiving layer is an aqueous ink receiving layer, meaning thus that the ink receiving layer composition contains a mixture of polyurethane dispersant and photo-initiator and a certain amount of water as solvent. The amount of water, in the mixture of the ink receiving layer composition, includes the amount of water added plus the amount of water in the suspensions and other components of the layer composition. In some examples, the aqueous mixture of the ink receiving layer includes water in an amount representing from about 10 to about 90 wt % by total weight of the ink receiving layer composition. In some other examples, the aqueous mixture of the ink receiving layer includes water in an amount representing from about 20 to about 80 wt %. In yet some other examples, the aqueous mixture of the ink receiving layer includes water in an amount representing from about 30 to about 70 wt % of the total weight of the ink receiving layer composition.

The ink receiving layer composition, according to the present disclosure, includes UV curable polyurethane dispersion, i.e. UV-PUD or UV curable polyurethane polymer particles or polyurethane polymer particles. As polyurethane dispersion, it is meant herein polyurethane particles that are dispersed in an aqueous liquid vehicle. The term "UV curable" refers herein to the fact that the polyurethane polymer has the ability to be cured (i.e. react) upon exposure to actinic radiation such as photo-radiation, e.g., ultraviolet (UV) radiation. The UV curable polyurethane dispersion refers herein to UV curable dispersion wherein the polyurethane polymer contains unsaturated double bond in the polyurethane configuration. It is believed that the unsaturated double bond provides to the polymer the ability to be cured and can be further used for crosslinking reaction under the exposure of UV light.

In some examples, polyurethane dispersions are stable dispersions, in water, of polyurethane polymer particles having an average particle sizes ranging from about 20 to about 200 nm. The polyurethane dispersions can have an Mw in the range of about 1,000 to 100,000 or in the range of about 5,000 to about 50,000.

In some examples, the polyurethane dispersions are present in the ink receiving layer in an amount representing from about 50 wt % to about 99 wt % of the total dry weight of the ink receiving layer composition. In some other examples, the polyurethane dispersions are present, in the ink receiving layer, in an amount representing from about 60 wt % to about 95 wt % of the total dry weight of the ink receiving layer composition. In yet some other examples, the polyurethane dispersions are present, in the ink receiving layer, in an amount representing from about 70 wt % to about 90 wt % of the total dry weight of the ink receiving layer composition.

In some examples, the UV curable polyurethane dispersion is an aliphatic acrylate polyurethane dispersion or an aliphatic polyurethane dispersion.

Polyurethane polymer particles can have a core-shell structure with a branched inner core structure, wherein the core includes an amine cross-linker in an amount of about 0.1 wt % to about 1 wt % and wherein the shell includes a polyol cross-linker in an amount of about 0.5 wt % to about 2 wt %. The branched inner core structure can be provided by a branched diisocyanate which can be a cyclic diisocyanate. The branched inner core structure can also be provided by a branched diol or a cyclic diol. Polyurethane particles may further contain polymerized monomers including a polyol, a branched diisocyanate, and an acid polyol. Polyurethane polymer particles can include a hard segment (including a diisocyanate) and a soft segment and can also include a chain extender. A chain extender can be any compound capable of polymerizing with the diisocyanate such that the chain extender resides in the hard segment of the polyurethane.

Polyurethane polymer particles include various polyols that can be present as a diol polymerized within a hard segment of the polyurethane particle. In some examples, the polyol can be a diol selected from the group of: cyclic diols; 1,3-cyclohexanedimethanol; 1,4-cyclohexanedimethanol; aliphatic polycarbonate diols; polyether diols; polyethylene glycol; polypropylene glycol; polytetramethylene glycol; poly(ethylene oxide) polymers; poly(propylene oxide) polymers; poly(tetramethylene oxide) polymers; copolymers thereof having terminal hydroxyl groups derived from polyhydric compounds including diols; and combinations thereof. In one aspect, the diol can be cyclic diol. In another aspect, the diol can be an aliphatic cyclic diol. In still another aspect, the diol can be 1,4-cyclohexanedimethanol. The diisocyanates can be selected from the group of cycloaliphatic diisocyanates, bis(4-isocyanotocyclohexyl) methane, methylene diphenyl diisocyanate, hexamethylene diisocyanate, p-tetramethyl xylene diisocyanate, m-tetramethyl xylene diisocyanate, bitolylene diisocyanate, toluene diisocyanate, methylene-bis(4-cyclohexyl)diisocyanate, p-phenylene diisocyanate, isophorone diisocyanate, 1,5-naphthalene diisocyanate, and mixtures thereof. In one aspect, the diisocyanate can be a cycloaliphatic diisocyanate. The acid polyol can have the structure HO—$(CH_2)n(CR_1R_2)m(CH_2)p$-OH where $R_1$ and $R_2$ are independently H, hydroxyl, an alkyl group, or an acid group; n ranges from 0 to 20; p ranges from 0 to 20; and m ranges from 1 to 20; wherein at least one of $R_1$ and $R_2$ is an acid group.

In some examples, UV-PUD are water-dispersible acrylic functional polyurethane dispersions. In some other examples, UV-PUD are water-dispersible (meth)acrylated polyurethane dispersions. By water-dispersible (meth)acrylated polyurethane is meant herein a polymer that, when mixed with water, can form a two-phase system of small particles dispersed in water.

Such polyurethane dispersions can be obtained from the reaction of at least one poly-isocyanate compound, optionally, at least one polyol; at least one hydrophilic compound containing, at least, one reactive group capable to react with isocyanate groups and which is capable to render the polyurethane dispersible in aqueous medium either directly or after reaction with a neutralizing agent to provide a salt, and at least one (meth)acrylated compound containing, at least, one reactive group capable to react with isocyanate groups. Water-dispersible (meth)acrylated polyurethane can be, water-dispersible resins, such as, for examples, compounds commercialized under the name of Ucecoat®7849, Ucecoat®7788 and Ucecoat®7733 available from Allnex. Such water-dispersible resins can form solution in water when mixed in the appropriate solubility ratio with water, such as, for example solution containing up to 10 wt % of water and 90 wt % of polymer.

The UV curable polyurethane dispersions (UV-PUD) can be water-dispersible (meth)acrylated polyurethane sold under the trade name of NeoRad® R441 by NeoResins (Avecia). Other representative but non limiting examples of UV-PUD include Ucecoat®7710, Ucecoat®7655 (available from Allnex), Neorad®R440, Neorad®R441, Neorad®R447, Neorad®R448 (available from DSM NeoResins), Bayhydrol®UV 2317, Bayhydrol®UV VP LS 2348 (available from Bayer), Lux®430, Lux®399. Lux®484 (available from Alberdingk Boley), Laromer®LR8949, Laromer®LR8983, Laromer® PE22WN, Laromer®PE55WN, Laromer®UA9060 (available from BASF). In some other examples, UV curable polyurethane dispersions are aliphatic polyurethane dispersion sold under the trade name Ucecoat®7571 or Ucecoat®7689 (available from Allnex).

The ink receiving layer composition according to the present disclosure includes, at least, a photo-initiator. The photo-initiator, or UV initiator, is an agent that initiates a reaction upon exposure to a desired wavelength of UV light to cure the compositions in the ink receiving layer. In some examples, the photo-initiator is a radical photo-initiator. The photo-initiator may be a single compound or a mixture of two or more compounds. In some examples, the photo-initiator is present in an amount representing from about 1 to about 50 wt % based on the total dry weight of the ink receiving layer. In some other examples, the photo-initiator is present in an amount representing from about 5 to about 40 wt % based on the total dry weight of the ink receiving layer.

The photo-initiator can be a water-soluble or a water-dispersible photo-initiator. The photo-initiator may be a combination of few photo-initiators, which absorb at different wavelengths.

Examples of photo-initiator include, by way of illustration and not limitation, 1-hydroxy-cyclohexylphenylketone, benzophenone, 2,4,6-trimethylbenzo-phenone, 4-methylbenzophenone, diphenyl-(2,4,6-trimethylbenzoyl)phosphine oxide, phenyl bis(2,4,6-trimethylbenzoyl)phosphine oxide, 2-hydroxy-2-methyl-1-phenyl-1-propanone, benzyl-dimethyl ketal, 2-methyl-1-[4-(methylthio)phenyl]-2-morpholinopropan-1-one, or combinations of two or more of the above. Amine synergists may also be used, such as, for example, ethyl-4-dimethylaminobenzoate, 2-ethylhexyl-4-dimethylamino benzoate. In some examples, the photo-initiator is a dispersion of Bis-acyl-phosphineoxide (BAPO) in water (available under the trade name Irgacure®819-DW from BASF) or is 1-[4-(2-Hydroxyethoxy)-phenyl]-2-hydroxy-2-methyl-1-propane-1-one (available under the trade name Irgacure®2859 from BASF) or is Phenyl-bis(2,4,6-trimethylbenzoyl)-phosphineoxide) (available under the trade name Irgacure®2100 from BASF).

In some examples, a photosensitizer may be used with the photo-initiator in amounts ranging from about 0.01 to about 10 wt %, or from about 1 to about 5 wt %, based on the total dry weight of the ink receiving layer. A photosensitizer absorbs energy and then transfers it to another molecule, usually the photo-initiator. Photosensitizers are often added to shift the light absorption characteristics of a system. Suitable examples of photosensitizers include, but are not limited to thioxanthone, 2-isopropylthioxanthone and 4-isopropylthioxanthone.

In addition to the above-described components, the ink receiving layer formulations might also contain other components or additives, as necessary, to carry out the required mixing, coating, manufacturing, and other process steps, as well as to satisfy other requirements of the finished product, depending on its intended use. The additives include, but are not limited to, one or more of rheology modifiers, thickening agents, cross-linking agents, surfactants, defoamers, optical brighteners, dyes, pH controlling agents or wetting agents, and dispersing agents, for example. The total amount of additives, in the composition for forming the ink receiving layer, can be from about 0.1 wt % to about 10 wt % or from about 0.2 wt % to about 5 wt %, by total dry weight of the ink receiving layer.

In some examples, according to the principles described herein, a method of making a printable recording media comprising a substrate (110) and an ink receiving layer (120) is provided. Such method encompasses providing a substrate (110); applying an ink receiving layer (120) that contains an aqueous mixture of about 50 to about 99 wt % of a UV curable polyurethane dispersion and about 1 to about 50 wt % of a photo-initiator by total dry weight of said ink receiving layer; and drying said ink receiving layer. In some examples, the ink receiving layer (120) is applied to the substrate (110) on one side (on the image receiving side) of the substrate. In some other examples, the ink receiving layer (120) is applied on both sides of the substrate (110) (on the image receiving side and on the backside).

The ink receiving layer (120) can be applied to the substrate (110) by using one of a variety of suitable coating methods, for example blade coating, air knife coating, metering rod coating, size press, curtain coating, or another suitable technique. In some examples, the ink receiving layer can be applied in one single production run. When the ink receiving layers are present on both sides of the substrate, depending on set-up of production machine in a mill, both sides of the substrate may be coated during a single manufacture pass, or each side is coated in a separate pass.

In some examples, after the coating step, the media might go through a drying process to remove water and other volatile components present in the ink receiving layer and substrate. The drying pass may comprise several different drying zones, including, but not limited to, infrared (IR) dryers, hot surface rolls, and hot air floatation boxes. In some other examples, after the coating and drying steps, the coated web may receive a glossy or satin surface with a calendering or super calendering step. When a calendering step is desired, the coated product passes an on-line or off-line calender machine, which could be a soft-nip calender or a super-calender. The rolls, in the calender machine, may or may not be heated, and certain pressure can be applied to calendering rolls. In addition, the coated product may go through embosser or other mechanical roller devices to modify surface characteristics such as texture, smoothness, gloss, etc.

In some examples, the ink receiving layer can be associated with the print media. The phrase "associated with" means that a layer is, for example, formed on, coated on, adsorbed on or absorbed in at least one surface of the print media substrate. The association between a layer and a surface of the print media substrate is achieved by bringing the substrate and composition forming the layer into contact by, for example, spraying, dipping and coating (including, e.g., roll, blade, rod, slot die, or curtain coating).

When the base substrate is base paper stock, the composition for forming the ink receiving layer can be applied on the base paper stock by an in-line surface size press process such as a puddle-sized press or a film-sized press, for example. In addition to in-line surface sizing processing, off-line coating technologies can also be used to apply the composition for forming the ink receiving layer to the print media substrate. Examples of suitable coating techniques include, but are not limited to, slot die coaters, roller coaters, fountain curtain coaters, blade coaters, rod coaters, air knife coaters, gravure applications, and air brush applications, for example.

A method for producing printed images or printing method, includes providing a printable recording media comprising a substrate and an ink receiving layer including an aqueous mixture of about 50 to about 99 wt % of an UV curable polyurethane dispersion and about 1 to about 50 wt % of a photo-initiator by total dry weight of said ink receiving layer; projecting of stream of droplets of an ink composition onto the media substrate; and applying photo energy to the printed media substrate, said photo energy having a frequency and energy level suitable for curing the ink composition and the compositions in the ink receiving layer. In some examples, the ink composition is a photo-curable ink composition.

By photo-curable ink composition, it is mean herein an ink composition that will have to be cured in order to provide a printed image. Examples of such ink composition can be water-based ink composition and will contains, for examples, a colorant, water, a photo-initiator and a UV curable polymer.

The projection of stream of droplets of ink composition, onto the media substrate, can be done via inkjet printing techniques. The ink composition may be established on the material via any suitable printing techniques, such techniques include thermal, acoustic, continuous and piezoelectric inkjet printing. In inkjet printing devices, liquid ink drops are applied in a controlled fashion to an ink-receiving substrate, or media substrate, by ejecting ink droplets from a plurality of nozzles, or orifices, in a printhead of an inkjet printing device or inkjet printer. In drop-on-demand systems, a droplet of ink is ejected from an orifice directly to a position on the surface of an ink-receiving substrate, or media substrate, by pressure created by, for example, a piezoelectric device, an acoustic device, or a thermal process controlled in accordance digital data signals. For inkjet printing, the ink composition can be heated or chilled to an appropriate dispensation temperature, prior to ejecting the ink composition to the surface of a substrate. In some examples, the projection of stream of droplets of ink composition, onto the media substrate, is done via a piezoelectric printhead. Thus, in some examples, the ink composition is applied onto the recording media using inkjet nozzles. In some other examples, the ink composition is applied onto the recording method using thermal inkjet printheads.

In some examples, the printing method is a capable of printing more than about 50 feet per minute (fpm) (i.e. has a print speed that is more than about 50 fpm). The printing method described herein can be thus considered as a high-speed printing method. The web-speed could be from about 100 to about 3000 feet per minute (fpm). In some other examples, the printing method is a printing method capable of printing from about 100 to about 1000 feet per minute. In yet some other examples, the printing method is capable of printing at a web-speed of more than about 200 feet per minute (fpm).

The printing method can be considered as a high-speed web press printing method. As "web press", it is meant herein that the printing technology encompasses an array of inkjet nozzles that span the width of the paper web. The array is thus able, for example, to print on 20", 30", and 42" wide web or on rolled papers. In some examples, the printing method as described herein prints on one-pass only. The paper passes under each nozzle and printhead only one time as opposed to scanning type printers where the printheads move over the same area of paper multiple times and only a fraction of total ink is used during each pass. The one-pass printing puts 100% of the ink from each nozzle/printhead down all at once and is therefore more demanding on the ability of the paper to handle all of the ink in a very short amount of time.

A suitable inkjet printer, according to the present method, is an apparatus configured to perform the printing and ink curing processes. The printer may be a single pass inkjet printer or a multi-pass inkjet printer. The printer may include a temperature stabilization module operative to ensure maintenance of the range of ink jetting temperatures. The printers that can be used include, without limitations, the HP T300 series Color Inkjet Webpress printer, the T200 series, or the T400 series Color Webpress printers (from Hewlett Packard Inc.).

In some examples, once the ink composition has been applied to the media, the media is cured by applying photo energy, said photo energy having a frequency and energy level suitable for curing the ink composition. In such curing step, a mercury or similar lamp can be used in order to fully cure and cross link the ink receiving layer composition to the media substrate. For applying photo energy, the ink receiving layer composition on the media substrate, may be subjected to suitable light sources for curing the ink receiving layer compositions in accordance with the principles described herein. Ultraviolet (UV) radiations can be used to cure the ink. Curing radiation can be UV radiation radiated by UV lamps, blue lasers. UV lasers, or ultraviolet LEDs, for example. The curing radiation may be provided by a source of ultraviolet radiation operating in a continuous mode. The curing radiation may also be provided by a source of ultraviolet operating in a flash or pulsed mode. In some examples, the printed article is cured by using, for example, a wide arc mercury lamp, in order to fully cure and crosslink the ink.

The present disclosure also refers to a printed article that results from the printing method described above. The printed article comprises a printable recording media having a substrate and an ink receiving layer including an aqueous mixture of about 50 to about 99 wt % of an UV curable polyurethane dispersion and about 1 to about 50 wt % of a photo-initiator by total dry weight of said ink receiving layer; and a photo-curable ink composition applied on said media, in order to from a printed image, where photo energy has been applied to the ink composition once printed, said photo energy having a frequency and energy level suitable for curing the photo-curable ink composition. In some examples, the printed article contains an ink receiving layer that includes a UV curable polyurethane dispersion that is an aliphatic acrylate polyurethane dispersion or an aliphatic polyurethane dispersion. In yet some other examples, the printed article includes an ink receiving layer wherein the weight ratio of the UV curable polyurethane dispersion to the photo-initiator, in the ink receiving layer, is between 85/25 and 95/5.

EXAMPLES

Ingredients

TABLE 1

| Ingredient name | Nature of the ingredient | supplier |
|---|---|---|
| Ucecoat ®7571 | UV curable polyurethane dispersions | Allnex |
| Ucecoat ®7689 | UV curable polyurethane dispersions | Allnex |
| Irgacure ®2100 | photo-initiators | BASF |
| Irgacure ®2959 | photo-initiators | BASF |
| Irgacure ®819DW | photo-initiators | BASF |
| Ebecryl ®8402 | Aliphatic Urethane Diacrylate | Allnex |
| DPGDA | 1,6-Hexanediol Diacrylate | Allnex |

Example 1—Coating Layer Formulations

The ink receiving layer formulations (a) to (g) are expressed in the Table 2 below (Formulation g is a comparative example). Each number represents the weight percentages (wt %) of each component based on the total amount of dry chemicals present in the coating layer formulation.

TABLE 2

| Formulation Sample | a | b | c | d | e | f | g |
|---|---|---|---|---|---|---|---|
| Ucecoat ®7571 | 90 | 90 | 90 | — | — | — | — |
| Ucecoat ®7689 | — | — | — | 90 | 90 | 90 | — |
| Irgacure ®2100 | 10 | — | — | 10 | — | — | — |
| Irgacure ®2959 | — | 10 | — | — | 10 | — | — |
| Irgacure ®819DW | — | — | 10 | — | — | 10 | 10 |
| Ebecryl ®8402 | — | — | — | — | — | — | 45 |
| DPGDA | — | — | — | — | — | — | 45 |

Example 2—Printable Recording Media

In the coating layer formulations (a) to (g), chemicals are mixed together in a tank by using normal stirring equipment. Such compositions (a) to (g) are applied at a coat weight of 3 gsm to both surfaces of a raw base paper using a Meyer rod in view of obtaining media samples A to G.

Comparative media samples H, I and J, are also produced. Media H is a raw base paper that does not contain any ink receiving layer. Media I is a raw base paper that contains a polymeric treatment solution (ink receiving layer) comprising a polymeric binder (starch), polyvalent metal salt ($Ca^{2+}$), latex (styrene-butadiene-based polymer) and an organic pigment (polyethylene wax). The polymeric binder, present in the layer, does not have the functional groups for further curing process under exposure to UV light. (Examples of such binders include also starch, cationic starch, modified starch, polyvinyl alcohol, cationic polyvinyl alcohol, modified polyvinyl alcohol, polyvinylpyrrolidone, cellulose, modified cellulose, polyvinyl acetate or acrylic polymer). The media J is a commercially available coated paper (Utopia Inkjet matte book paper 45# from Appleton Coated). Media J is a raw base paper that comprises an inkjet receiving coating comprising inorganic pigment (Ground Calcium Carbonate) and a binder (acrylic polymer)

Media samples A to J are printed with an identical image sequence (with a solid image at 400 dots per inch printed in 4 passes of 100 dpi each) using HP CM8060 Color MFP with A50 ink to simulate printing and drying process of HP Color Inkjet Web Press T-200 series. Immediately after drying, the printed image are cured by passing under a broad range UV lamp once at a speed of about 0.5 m/s.

Resistance and image quality tests are performed onto the obtained printed media. The tests are performed immediately after printing and also after a UV curing (i.e. before and after the UV curing step).

Durability tests (Resistance tests) are performed onto the printed media under conditions that simulated outdoor weathering and abrasion. The media are tested for "dry rub resistance" and "wet rub resistance". Dry Rub and Wet Rub resistance tests refer to the ability of a printed image to resist appearance degradation upon dry or wet rubbing the image (simulation rubbing with dry or wet fingers). Good rub resistance, upon rubbing, will tend not to transfer ink from a printed image to surrounding areas where the ink has not been printed and the black optical density (KOD) will be maintained. "Dry Rub" tests are performed with a "Taber Eraser dry rub" that is applied 3 cycles with 350 g weight to the media at 2 inch linear stroke. The cycles are made with the eraser in the black area fill print. The "Wet Rub" tests are performed with Taber Linear Abrader with a plastic rubbing tip wrapped with a wet cloth. The water rub test is used with a water wet cloth, 2 inch linear stroke is made across the print with the cloth wrapped tip set with 350 g weight and 1 cycle is applied. Each durability testing item is then given a rating score according to a 1 to 5 scale, as described in Table 3 below, wherein 1 means the worst performance (all the ink in the image has been removed), and 5 represents the best performance (the image shows no damage).

TABLE 3

| Score Value | Meaning |
|---|---|
| 5 | No Damage |
| 4 | Very slight damage |
| 3 | Some of ink gone |
| 2 | >50% of ink removed |
| 1 | See white paper, ink total damage or transfer |

Black optical density (KOD) and Color Gamut are measured for each prints, after the curing Step. The black optical density (KOD) is measured using an X-Rite densitometer that measures the reflectance of the area filled. The higher the KOD value, the darker the black colored image obtained. Gamut Measurement (Color Gamut) represents the amount of color space covered by the ink on the media. Gamut volume is calculated using L*a*b* values of 8 colors (cyan, magenta, yellow, black, red, green, blue, white) measured with an X-RITE®939 Spectro-densitometer (X-Rite Corporation), using D65 illuminant and 2° observer angle. Black optical density (KOD) is the measurement of the change in reflectance $OD=\log_{10}(I_i/I_r)$, where $I_i$ is incident light intensities and $I_r$ is reflected light intensities.

The media samples A to J are also evaluated for their handleability and their opacity. The samples are then given a rating score according to a 1 to 5 scale (wherein 1 means the worst performance and 5 represents the best performance). The handleability defined the ability to handle properly the media. The opacity is tested using TAPPI test method T425 (with reflectance measurements). Higher opacity values indicate that it is more difficult to see through the sheet of paper.

The results of these tests are illustrated in Table 4. According to such results, it can be seen that the media with the coating composition of the present disclosure provides the best overall scores on durability after the curing step and the best image quality.

TABLE 4

| MEDIA SAMPLES | A | B | C | D | E | F | G | H | I | J |
|---|---|---|---|---|---|---|---|---|---|---|
| Image quality (color gamut) | 163K | 165K | 183K | 188K | 194K | 202K | 162K | 165K | 140K | 170K |
| Score Before UV curing | | | | | | | | | | |
| Dry rubbing resistance | 2 | 2 | 2 | 2 | 2 | 2 | 4 | 3.5 | 2 | 2 |
| Wet rubbing resistance | 1.5 | 1.5 | 1.5 | 1.5 | 1.5 | 1.5 | 2 | 1.5 | 2 | 1 |
| Score After UV curing | | | | | | | | | | |
| Dry rubbing resistance | 4.5 | 4.5 | 4.5 | 4 | 4 | 4 | 4 | 3 | 2 | 2 |
| Wet rubbing resistance | 4 | 4 | 4 | 4 | 4 | 4 | 3 | 1 | 2 | 1 |
| KOD | 1.31 | 1.34 | 1.41 | 1.43 | 1.45 | 1.44 | 1.23 | 1.34 | 1.37 | 1.29 |
| Paper opacity | 5 | 5 | 5 | 5 | 5 | 5 | 1 | 5 | 5 | 5 |
| Handleability before UV curing | 5 | 5 | 5 | 5 | 5 | 5 | 1 | 5 | 5 | 5 |

The invention claimed is:

1. A printable recording medium, comprising:

a substrate; and an ink receiving layer including an aqueous mixture of about 50 wt % to about 99 wt % of an UV curable polyurethane dispersion and about 1 wt % to about 50 wt % of a photo-initiator by total dry weight of said ink receiving layer, wherein a polyurethane polymer of the UV curable polyurethane dispersion contains an unsaturated double bond.

2. The printable recording medium of claim 1 wherein the aqueous mixture of the ink receiving layer includes water in the range of about 10 wt % to about 90 wt % of the total weight of the ink receiving layer.

3. The printable recording medium of claim 1 wherein the UV curable polyurethane dispersion is present, in the ink receiving layer, in an amount representing from about 60 wt % to about 95 wt % of the total dry weight of the ink receiving layer.

4. The printable recording medium of claim 1 wherein the photo-initiator is present, in the ink receiving layer, in an amount representing from about 5 wt % to about 40 wt % of the total dry weight of the ink receiving layer.

5. The printable recording medium of claim 1 wherein a weight ratio of the UV curable polyurethane dispersion to the photo-initiator, in the ink receiving layer, is between 80/20 and 99/1.

6. The printable recording medium of claim 1 wherein a weight ratio of the UV curable polyurethane dispersion to the photo-initiator, in the ink receiving layer, is between 85/25 and 95/5.

7. The printable recording medium of claim 1 wherein the UV curable polyurethane dispersion is an aliphatic acrylate polyurethane dispersion or an aliphatic polyurethane dispersion.

8. The printable recording medium of claim 1 wherein the substrate is a paper base substrate.

9. The printable recording medium of claim 1 wherein the ink receiving layer is applied to one side of the substrate and forms a layer having a coat-weight in the range of about 0.5 gsm to about 30 gsm.

10. The printable recording medium of claim 1 wherein the ink receiving layer is applied to both sides of the substrate and has a coat-weight in the range of about 1 gsm to about 5 gsm per side.

11. A method for making a printable recording medium, comprising:

(a) providing a substrate;

(b) applying an ink receiving layer, that contains an aqueous mixture of about 50 wt % to about 99 wt % of a UV curable polyurethane dispersion and about 1 wt % to about 50 wt % of a photo-initiator by total dry weight of the ink receiving layer, on one side of the substrate, wherein a polyurethane polymer of the UV curable polyurethane dispersion contains an unsaturated double bond; and (c) drying said ink receiving layer.

12. The method for making a printable recording medium according to claim 11 wherein the ink receiving layer is applied on both sides of the substrate.

13. A printed article, comprising:

(a) a printable recording medium having a substrate and an ink receiving layer including an aqueous mixture of about 50 wt % to about 99 wt % of a UV curable polyurethane dispersion and about 1 wt % to about 50 wt % of a photo-initiator by total dry weight of the ink receiving layer, wherein a polyurethane polymer of the UV curable polyurethane dispersion contains an unsaturated double bond; and (b) an ink composition applied on said medium, in order to from a printed image, where photo energy has been applied to the ink composition once printed, said photo energy having a frequency and energy level suitable for curing the ink composition and the ink receiving layer.

14. The printed article of claim 13 wherein the UV curable polyurethane dispersion of the ink receiving layer is an aliphatic acrylate polyurethane dispersion or an aliphatic polyurethane dispersion.

15. The printed article of claim 13 wherein a weight ratio of the UV curable polyurethane dispersion to the photo-initiator, in the ink receiving layer, is between 85/25 and 95/5.

16. The printable recording medium of claim 1 wherein a weight ratio of the UV curable polyurethane dispersion to the photo-initiator, in the ink receiving layer, is 90/10.

17. The printable recording medium of claim 1 wherein the photo-initiator is selected from the group consisting of phenyl-bis(2,4,6-trimethylbenzoyl)-phosphineoxide), bis-acyl-phosphineoxide, and combinations thereof.

18. The printable recording medium of claim 1 wherein the ink receiving layer further includes a photosensitizer.

19. The printed article of claim 13 wherein the ink composition is a water-based ink composition.

* * * * *